United States Patent [19]

Ban

[11] Patent Number: 4,826,063

[45] Date of Patent: May 2, 1989

[54] ROLL HOLDER

[76] Inventor: Kazu Ban, 13-13, Yamatedai 3-chome, Ibaragi-shi, Osaka, Japan

[21] Appl. No.: 82,649

[22] Filed: Aug. 7, 1987

[30] Foreign Application Priority Data

Dec. 6, 1986 [JP] Japan ..... 61-291295
May 30, 1987 [JP] Japan ..... 62-84082[U]

[51] Int. Cl.[4] ..... B65H 35/10

[52] U.S. Cl. ..... 225/52; 225/74; 225/85

[58] Field of Search ..... 225/51, 52, 73, 74, 225/80, 82, 84, 85, 86, 87, 89, 90

[56] References Cited

U.S. PATENT DOCUMENTS 387,262 8/1888 Locke ..... 225/85
1,135,859 4/1915 Stamirowski ..... 225/72
1,293,484 2/1919 Ley ..... 225/89 X
1,653,298 12/1927 Leidecker ..... 225/90 X
3,040,943 6/1962 Bump ..... 225/73 X
3,190,520 6/1965 Wyant ..... 225/73 X

*Primary Examiner*—Donald R. Schran
*Assistant Examiner*—Michael D. Folkerts
*Attorney, Agent, or Firm*—Wenderoth, Lind & Ponack

[57] ABSTRACT

A roll holder for holding and dispensing a roll of paper such as toilet paper. A paper roll is mounted so that its end will come out from behind. The paper can be easily pulled out downwardly. After a desired length has been pulled out, the paper is pulled forwardly. A working plate is pivoted under tension of the paper so that the paper will be pressed and braked between the working plate and a braking member of a resilient material. Simultaneously, a cutter coupled with the working plate will project out of the body so that the paper can be cut cleanly with a single hand.

3 Claims, 2 Drawing Sheets

ROLL HOLDER

BACKGROUND OF THE INVENTION

The present invention relates to a roll holder for holding a roll of paper such as toilet paper, resin film, metallic foil such as that used in a kitchen, or wrapping paper so that the paper from the roll housed in the holder can be pulled out and cut off with one hand.

Among the prior art toilet paper holders, there is one in which a roll of paper is mounted on a shaft; the paper is pulled out as necessary; a cover is then pressed against the roll of paper to hold the roll from turning; and at the same time the paper is cut off by the edge of the cover.

There is also known another type in which crosswise stitch lines are formed in the paper at uniform intervals to facilitate the cutting, or still another type in which the paper is forcibly hit against the teeth to cut the paper, taking advantage of the inertia force acting on the roll to keep it at rest.

A web of paper, resin film or metallic foil used in a kitchen is housed in a box in a roll form. When cutting such a web wherein its end is pulled out of the box through the opening, one has to cut off the web pulled out with one hand by means of a cutter fixed to the box, while holding the box with the other hand.

Among the aforesaid prior art holders, the first one poses difficulties in that the cutting operation requires the use of both hands and is thus troublesome, one has to touch the cover which may not be sanitary every time he uses it, and the end of the roll of paper tends to attach to the inner surface of the cover after cutting and is difficult to pull out for subsequent cutting.

With respect to the type in which the paper is forcibly hit against the teeth to cut, the paper has to be skillfully snapped at the teeth to obtain a clean cut. With respect to the type in which the web pulled out of the box is cut by means of the cutter outside of the box, both hands have to be used. Though by forming crosswise stitch lines in the paper, it may be cut off without a cutter, the extra step of forming the stitch lines has to be added to the production process of the toilet paper.

SUMMARY OF THE INVENTION

A web of paper hanging down along a working plate is held at its edge and pulled down until a desired length of web is drawn out. The web is then pulled forward so as to be bent at the lower edge of the working plate at an acute angle. As the web is pulled forward, the working plate is also pivoted and pressed against a braking member, applying a braking force to the web.

The web is pulled up and pressed against a cutter and is cut. After cutting, the portion of the web between the cutter and the working plate hangs down to release the braking member.

With the cutter mounted movably relative to a holder body and coupled to the working plate, when the web is pulled down and then pulled forward to pivot the working plate slightly forward, the cutter also pivots such that its teeth extend downwardly so that the web can be readily cut off.

With the roll holder of the present invention, the web can be readily cut clean with one hand just by pulling it forward after pulling it out downwardly, unlike the prior art holders which require both hands to cut the web.

If the paper is toilet paper which can be cut off with a cutter having no sharp teeth, the cutter may be of a fixed type. If the web is of an aluminum foil, a synthetic resin film or wrapping paper, the teeth have to be sharp. In that case, as shown in the embodiment the working plate and the cutter should be rockingly mounted so that as the working plate pivots forward under tension when the web is being drawn forward, the edge of the cutter coupled to the working plate will stick out downwardly. The cutting edge which is dangerous and unattractive to the eye is retracted in the holder when not in use.

Since the paper is fed out not from front but from behind the holder, the moving parts such as the working plate and the cutter are disposed below the roll. This arrangement minimizes the projection of the holder from the wall surface. Thus the holder can be waterproofed rather easily. In order to obtain a clean cut, when the web is in contact with the cutter teeth under tension necessary for cutting, a dragging force matching this tension has to act on the web between the working plate and the braking member. If toilet paper is used, which is coarse and thin and studded with flocs of fibre, and thus is apt to be hitched and torn at such portions, the braking member should be divided into a plurality of leaf springs so that the friction between each leaf spring and the web will be kept small. These relatively small frictions are collected into a mass of braking power. Since each friction is small, it is less likely that a breaking force may concentrate locally and tear the web.

Other features and objects of the present invention will become apparent from the following description taken with reference to the accompanying drawings, in which:

DETAILED DESCRIPTION OF THE PREFERRED EMBODIMENT

Figure 1:
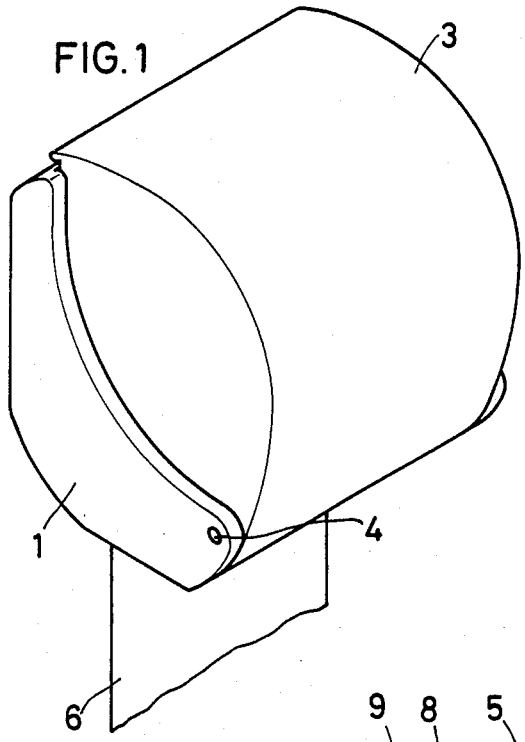
FIG. 1 is a perspective view of an embodiment of the present invention.
Figure 2:
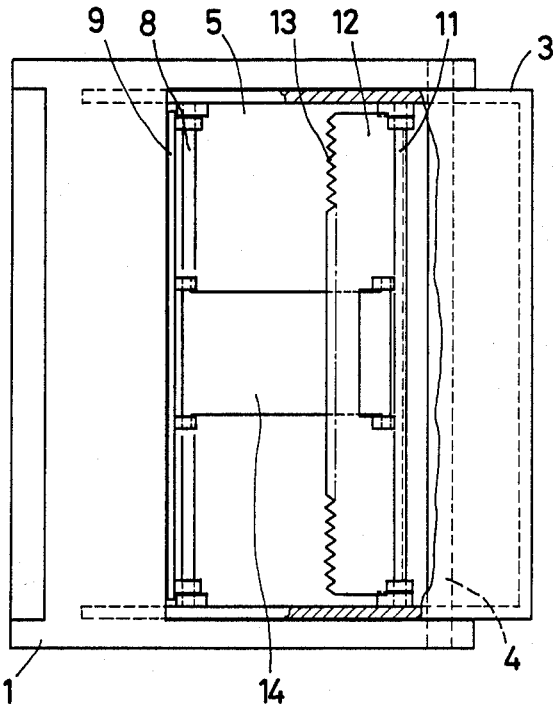
FIG. 2 is a bottom view of the same.

In the drawings, there is shown a holder for toilet paper, which comprises a support frame 1 adapted to be fixed to a wall 2 and having an open front and a holder body 3 pivotally mounted on the support frame 1 through a shaft 4 disposed at the front lower part thereof. The holder body 3 is provided with side walls and is semi-circular in section and is open at the side facing the support frame 1.

In the body 3 near the lower end thereof, there is provided an arcuate support 5 having its upper surface recessed to receive a roll 7 of toilet paper 6.

Below the support 5 is provided a working plate 9 having its upper part near the top rockingly mounted on a shaft 8 extending parallel with the axis of the roll 7. The plate 9 has a width substantially equal to that of the toilet paper 6.

Further, a cutter 12 has its top rockingly coupled to the bottom front end of the support 5 through a shaft 11 parallel with the shaft 8. The cutter is provided at its lower edge with teeth 13 such as serrated ones.

The working plate 9 is coupled to the cutter 12 by means of a link 14 so that as the working plate 9 pivots forward, the cutter 12 will pivot forward so that its teeth 13 extend out of the body 3 through an opening 15 at its bottom.

A braking member 16 has its rear end fixed to a clamp face 17 of the support frame 1. The braking member 16 of a resilient material is arched from the rear end so that its leading end will extend downwardly and press against the upper part of the working plate 9.

The contact point between the working plate 9 and the braking member 16 should be located above the shaft 8 so that a torque causing the lower end of the working plate 9 to swing toward the wall will act thereon.

Figure 5:
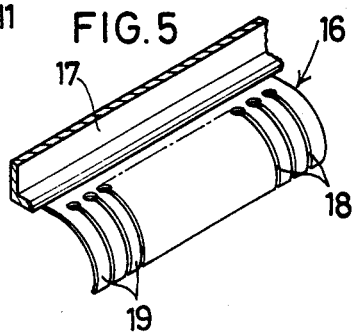
FIG. 5 is a partially cutaway perspective view of a braking member.
Figure 4:
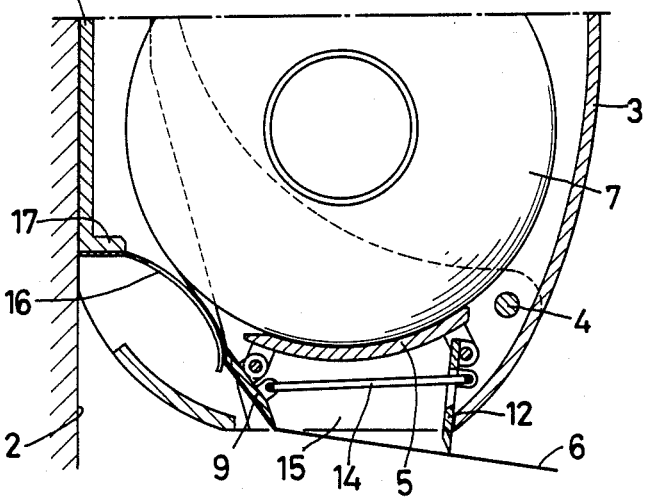

The braking member 16 is formed with a plurality of longitudinal slits 18 extending in parallel from its lower edge to divide it into a plurality of parts 19 as shown in FIG. 5. The parts 19 may be separately attached at upper ends thereof to the clamp face 17 so that each part will exhibit resilience separately.

In operation, the holder body 3 is pivoted forward around the shaft 4 to open its top and the roll 7 of toilet paper is mounted in the body 3 through the opening. The web of toilet paper is held by the end portion thereof at the top of the holder and its pulled downwardly between the braking member 16 and the working plate 9. After the end of the toilet paper 6 has been pulled out of the body 3, the body is pivoted toward the support frame 1 to cover the top opening.

Figure 3:
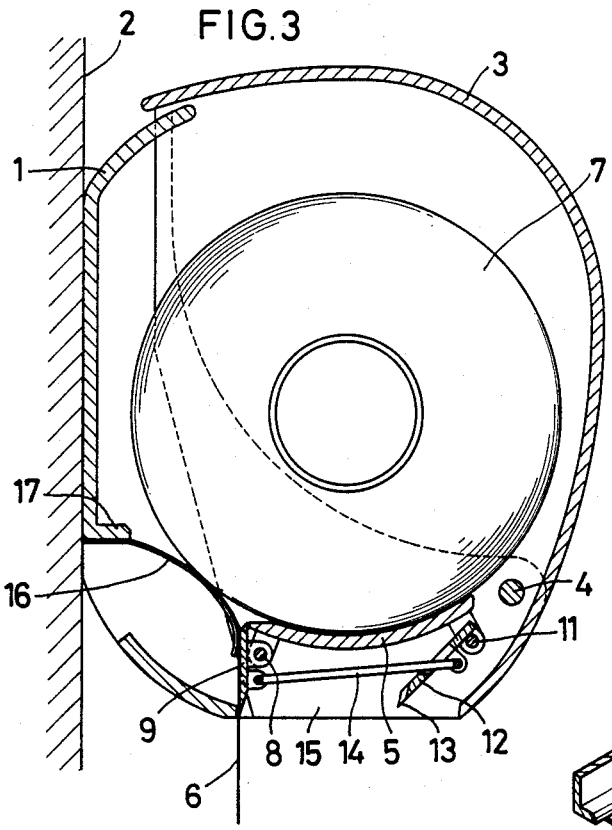
FIGS. 3 and 4 are vertical sectional side views of the same in use.

Now, the toilet paper 6 hangs down with an intermediate portion thereof lightly pressed between the working plate 9 and the braking member 16 as shown in FIG. 3. Since in this state the divided parts 19 of the braking member 16 have their tips lightly pressed toward the back of the working plate 9, they do not prevent the paper from being pulled out.

After the toilet paper 6 has been pulled out to a desired length, it is then horizontally pulled forward so as to be bent at substantially a right angle at the lower end of the working plate 9. As the paper 6 is pulled forward, the working plate 9 pivots forward around the shaft 8.

Thus the upper rear surface of the working plate 9 is pressed hard toward the braking member 16 to apply a braking force to the paper 6 sandwiched therebetween. Also, simultaneously with the forward pivotal movement of the working plate 9, the cutter 12 coupled therewith pivots forward such that teeth 13 extend out downwardly through the opening 15. The paper 6 will be readily cut off by bringing it into contact with the teeth 13 and further pulling it up.

The portion of the paper 6 left at the side of the working plate 9 will hang down for a length substantially equal to the distance between the lower end of the working plate 9 and the cutter 12. This portion serves as a handhold when pulling out the paper 6 next time.

What are claimed are:

1. A roll holder for holding a roll of paper, comprising:

a holder body;

a support fixedly mounted in and extending in the direction from the front to the rear of said holder body for supporting the roll of paper;

a working plate pivotally mounted below said support;

a braking means made of a resilient material and mounted behind said working plate for applying braking force to the paper pulled downwardly out of the roll and guided between said working plate and said braking means; and a cutter mounted on said support forwardly of said working plate for cutting the paper pulled downwardly and then forwardly;

whereby said working plate is pivoted under tension of the paper when the paper is pulled forwardly, thereby pressing the paper between said braking means and said working plate for braking, and the paper is cut when the paper is pulled upwardly against said cutter.

2. A roll holder as claimed in claim 1, in which said cutter is moveably mounted on said support for being moveable from an inoperative position within said holder body to an operative position out of said holder body, said roll holder further comprising a coupling means for coupling said cutter with said working plate, for causing said cutter to move out of said holder body into its operative position when said paper is pulled forwardly to pivot said working plate.

3. A roll holder as claimed in claim 1, wherein said braking means is provided with a plurality of longitudinal slits to divide it into a plurality of portions.

* * * * *